US011204187B2

(12) United States Patent
Ford

(10) Patent No.: US 11,204,187 B2
(45) Date of Patent: Dec. 21, 2021

(54) MIXED MODEL COMPRESSOR

(71) Applicant: Danfoss A/S, Nordborg (DK)

(72) Inventor: Frank D. Ford, Tallahassee, FL (US)

(73) Assignee: Danfoss A/S

( * ) Notice: Subject to any disclaimer, the term of this patent is extended or adjusted under 35 U.S.C. 154(b) by 153 days.

(21) Appl. No.: 16/034,457

(22) Filed: Jul. 13, 2018

(65) Prior Publication Data

US 2019/0017732 A1 Jan. 17, 2019

Related U.S. Application Data

(60) Provisional application No. 62/532,521, filed on Jul. 14, 2017.

(51) Int. Cl.
*F25B 13/00* (2006.01)
*F25B 49/02* (2006.01)

(52) U.S. Cl.
CPC ..... *F25B 13/00* (2013.01); *F25B 49/022* (2013.01); *F25B 2339/047* (2013.01); *F25B 2400/0751* (2013.01); *F25B 2400/13* (2013.01); *F25B 2600/2509* (2013.01)

(58) Field of Classification Search
CPC ..... F25B 13/00; F25B 49/022; F25B 2600/2509; F25B 2339/047; F25B 2400/0751; F25B 2400/13
See application file for complete search history.

(56) References Cited

U.S. PATENT DOCUMENTS 4,384,462 A 5/1983 Overman et al.
5,845,509 A 12/1998 Shaw et al.
6,579,067 B1 6/2003 Holden
7,231,773 B2 6/2007 Crane et al.
7,793,509 B2 9/2010 Crane
2005/0223720 A1* 10/2005 Miller ..... F25B 49/00 62/129
2005/0262859 A1* 12/2005 Crane ..... F25B 49/025 62/197
2007/0056300 A1* 3/2007 Crane ..... F25B 49/025 62/175
2009/0229280 A1* 9/2009 Doty ..... F25B 1/00 62/115
2010/0186433 A1* 7/2010 Galante ..... F04C 29/04 62/115

(Continued)

OTHER PUBLICATIONS

Caballero et al., A chiller Control Algorithm for Multiple Variable-speed Centrifugal Compressors, 22nd International Compressor Engineering Conference at Purdue, Jul. 14-17, 2014, Purdue e-Pubs, paper 2340; p. 1435, https://docs.lib.purdue.edu/icec/2340/. (Year: 2014).*

(Continued)

*Primary Examiner* — Emmanuele E Duke

(74) *Attorney, Agent, or Firm* — Carlson, Gaskey & Olds, P.C.

(57) ABSTRACT

A chiller system according to an exemplary aspect of the present disclosure includes a compressor section and a controller. The compressor section has a first refrigerant compressor having a first cooling capacity and a second refrigerant compressor having a second cooling capacity different from the first cooling capacity. The controller is configured to selectively operate the first and second refrigerant compressors.

20 Claims, 5 Drawing Sheets

(56) References Cited

U.S. PATENT DOCUMENTS

| | | | | |
|---|---|---|---|---|
| 2010/0326098 | A1* | 12/2010 | Rog | F25B 27/00 62/101 |
| 2011/0048046 | A1* | 3/2011 | Sommer | F25B 1/053 62/228.1 |
| 2011/0192188 | A1* | 8/2011 | Nickey | F28B 1/06 62/507 |
| 2013/0291808 | A1* | 11/2013 | Kautto | F22B 1/1846 122/7 R |
| 2014/0013782 | A1* | 1/2014 | Kopko | F25B 1/06 62/115 |
| 2014/0069120 | A1* | 3/2014 | Takemoto | F25B 49/02 62/56 |
| 2016/0222970 | A1 | 8/2016 | Becker et al. | |
| 2017/0089627 | A1 | 3/2017 | Lee et al. | |
| 2017/0241690 | A1* | 8/2017 | Groshek | F04C 28/08 |

OTHER PUBLICATIONS

Caballero et al.; A Chiller control Algorithm for Multiple Variable-speed Centrifugal Compressor, 2014, Purdue ePubs., http://docs.lib.purdue.edu/icec/2340 (Year: 2014).*

Chillers Energy Saving Fact Sheet, May 2010, North Carolina Energy Office: https://files.nc.gov/ncdeq/Environmental%20Assistance%20and%20Customer%20Service/IAS%20Energy%20Efficiency/Opportunities/Chillers.pdf (Year: 2010).*

North Carolina Energy Office (NCEO), Chillers Energy Saving Fact Sheet, (2010), Waste Reduction Partners (Year: 2010).*

Caballero et al., A chiller Control Algorithm for Multiple Variable-speed Centrifugal Compressors, (2014), International Compressor Engineering Conference, Papar 2340. (Year: 2014).*

Jain et al., Capacity and Efficiency in Variable Speed, Vapor Injection and Multiple-Compressor Systems, (2004), Air Conditioning and Refrigeration Center, University of Illinois, Mechanical & Industrial Engineering Dept. (Year: 2004).*

Caballero, Piero, et al., "A Chiller Control Algorithm for Multiple Variable-speed Centrifugal Compressors," 22nd International Compressor Engineering Conference at Purdue, Jul. 14-17, 2014. Paper 2340. http://docs.lib.purdue.edu/icec/2340.

* cited by examiner

| OPTION | LOWEST PRICE | BEST FL EFF | BEST IPLV | MOST LIKELY FIXED MODEL |
|---|---|---|---|---|
| COMP CONFIGURATION | VTT (1) + TT400 (1) | VTT (1) + TT700 (1) | VTT (1) + TT700 (1) + TT300 (1) | TT700 (3) |
| FL EFFICIENCY | 0.568 | 0.554 | 0.558 | **0.584** |
| IPLV | 0.331 | 0.332 | 0.324 | **0.334** |
| COMP COST | −12% | −8% | **+13%** | --- |
| MIN CAPACITY (W/RELIEF) | 32 | 40 | 17 | 40 |
| MIN CAPACITY (CONSTANT HEAD) | 53 | 92 | 36 | 92 |

FIG.5

MIXED MODEL COMPRESSOR

RELATED APPLICATIONS

This application claims priority to provisional application 62/532,521, filed on Jul. 14, 2017.

BACKGROUND

This disclosure relates to a chiller system having a plurality of compressors.

Known chiller systems include a refrigerant circuit and a water circuit. Heat is exchanged between the refrigerant and water circuits. The refrigerant circuit often includes a condenser, an expansion device, an evaporator, and a compressor section. The compressor section compresses the fluid, which then travels to a condenser, which in turn cools and condenses the fluid. The refrigerant then goes to an expansion device, which decreases the pressure of the fluid, and to the evaporator, where the fluid is vaporized, completing a refrigeration cycle.

Many chiller systems, such as HVAC chiller systems, include multiple compressors within the compressor section. The compressors may be turned on and off depending upon the needs of the system. The plurality of compressors can include capability to vary the speed of the compressors as necessary based on the overall system demand. The control of the compressors is typically handled by a controller in the chiller that provides a signal for demand.

In many instances, each of the plurality of compressors is the same type of compressor, meaning the same model, which is known as a fixed model chiller. Operation of the compressors is simplest when the demand used for each compressor is taken to be the same across all compressors. This is called a balanced load distribution.

Each compressor model has unique performance in relating mass flow, power, and speed for a given set of conditions. The performance can vary along the range of operation considerably. When all compressor models are of the same type, operating them with balanced load distribution doesn't always provide the best total system efficiency because of the compressor model's inherent performance.

SUMMARY

A chiller system according to an exemplary aspect of the present disclosure includes a compressor section and a controller. The compressor section has a first refrigerant compressor having a first cooling capacity and a second refrigerant compressor having a second cooling capacity different from the first cooling capacity. The controller is configured to selectively operate the first and second refrigerant compressors.

A method of operating a chiller system according to exemplary aspect of the present disclosure includes providing a compressor section and having a first refrigerant compressor having a first cooling capacity and a second refrigerant compressor having a second cooling capacity higher than the first cooling capacity and selectively operating the first and second refrigerant compressors with a controller.

BRIEF DESCRIPTION OF THE DRAWINGS

FIG. 5 shows example compressor arrangements according to an embodiment.

DETAILED DESCRIPTION

Figure 1:
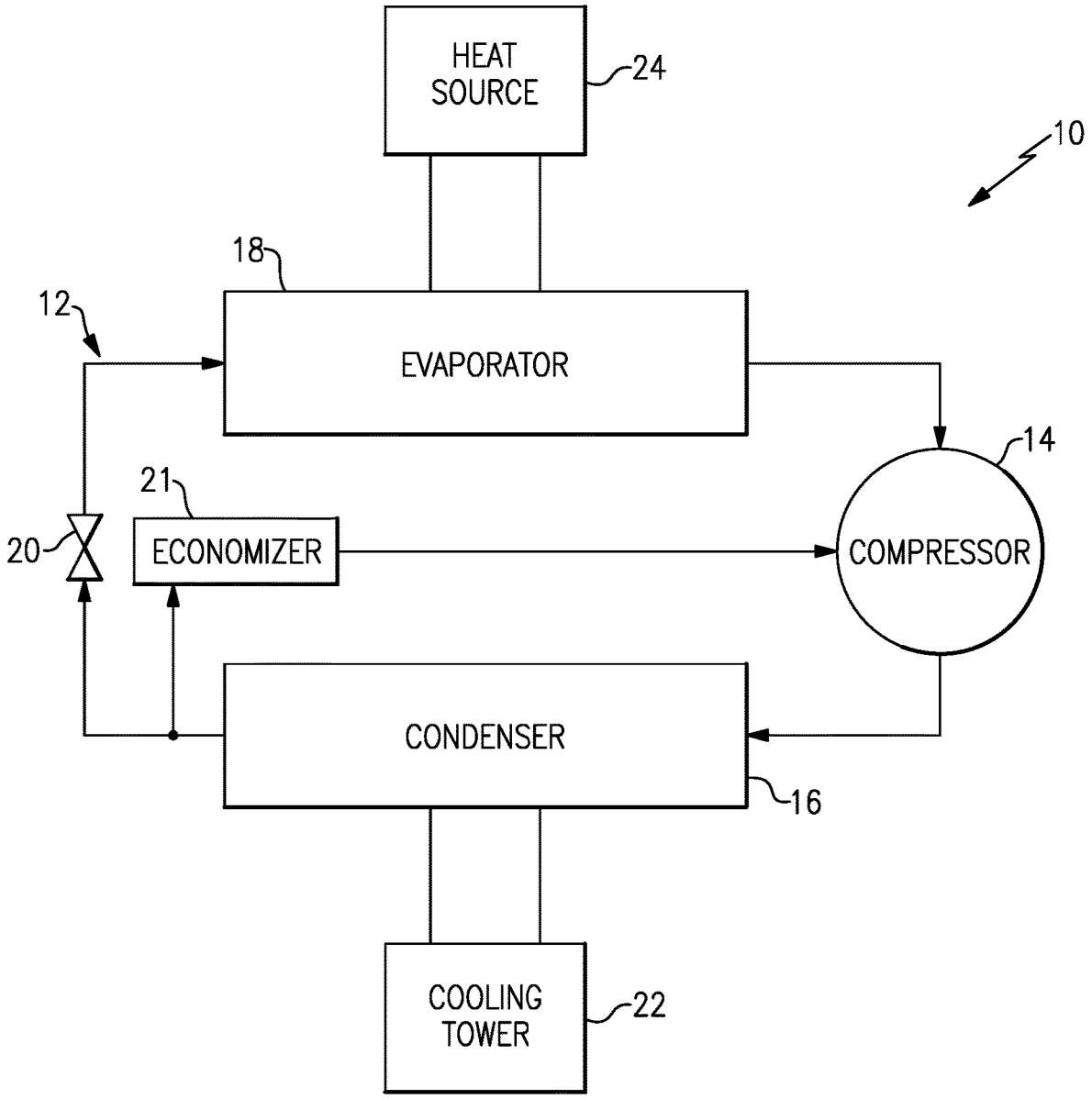
FIG. 1 schematically illustrates a chiller system.

FIG. 1 illustrates an exemplary chiller system 10. The chiller system 10 includes a main refrigerant loop, or circuit, 12 in communication with a compressor section 14, a condenser 16, an evaporator 18, and an expansion device 20. While a particular example of the refrigerant loop 12 is shown, this application extends to other refrigerant loop configurations. For instance, the refrigerant loop 12 can include an economizer 21 downstream of the condenser 16 and upstream of the expansion device 20.

The chiller system 10 also includes a secondary fluid loop. In an embodiment, the secondary fluid is water. In an embodiment, the condenser 16 includes a large barrel of water at a high temperature that is in communication with a cooling tower 22. The evaporator 18 includes a large barrel of water at a low temperature that is in communication with a heat source, such as a room to be cooled 24. This chiller system 10 may be used in an HVAC system, for example. Although a water cooled chiller is illustrated, other chillers, such as an air cooled chiller may come within the scope of this disclosure.

Figure 2:
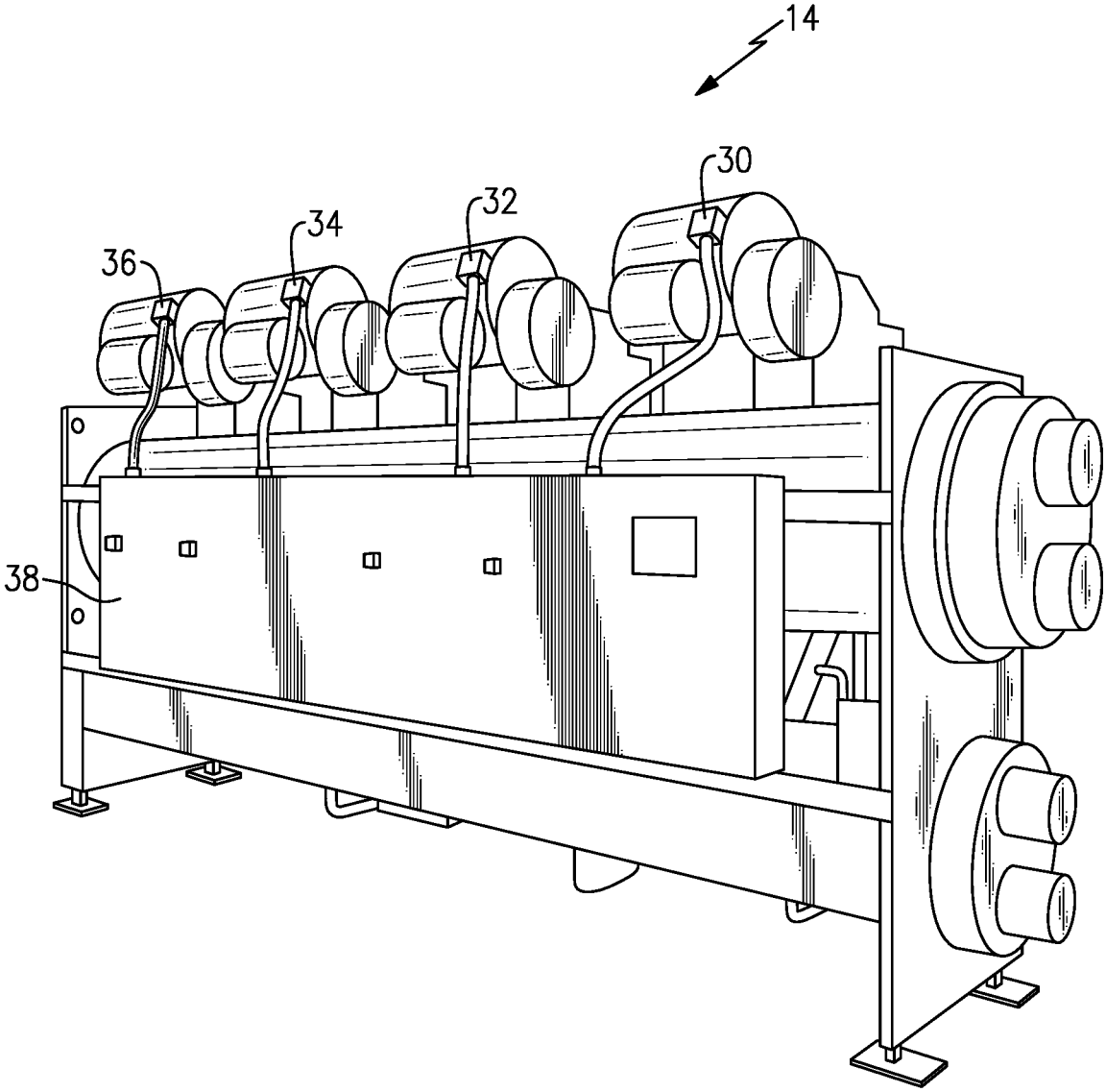
FIG. 2 illustrates a compressor section for a chiller system according to an embodiment.

FIG. 2 illustrates a compressor section 14 for a chiller system 10 according to an embodiment. The compressor section 14 includes a plurality of compressors 30, 32, 34, 36 controlled by a controller 38. In an embodiment, each of the plurality of compressors 30, 32, 34, 36 is a centrifugal compressor. In an embodiment, there may be several of a particular model of compressor present. Although four compressors are shown in the compressor section 14, this disclosure extends to fewer or additional compressors. For example, a chiller system 10 may have between two and twelve compressors in the compressor section 14. Additionally, the embodiment is of the water-cooled type chiller but this can also apply to an air-cooled type chiller. The embodiment in FIG. 2 can also have different compressor types. In one example, compressor 30 is a 300 kW compressor (TT300), compressor 32 is a 350 kW compressor (TT350), and compressors 34, 36 are 700 kW compressors (TT700). In other embodiments, different combinations of compressors may be used.

Figure 3:
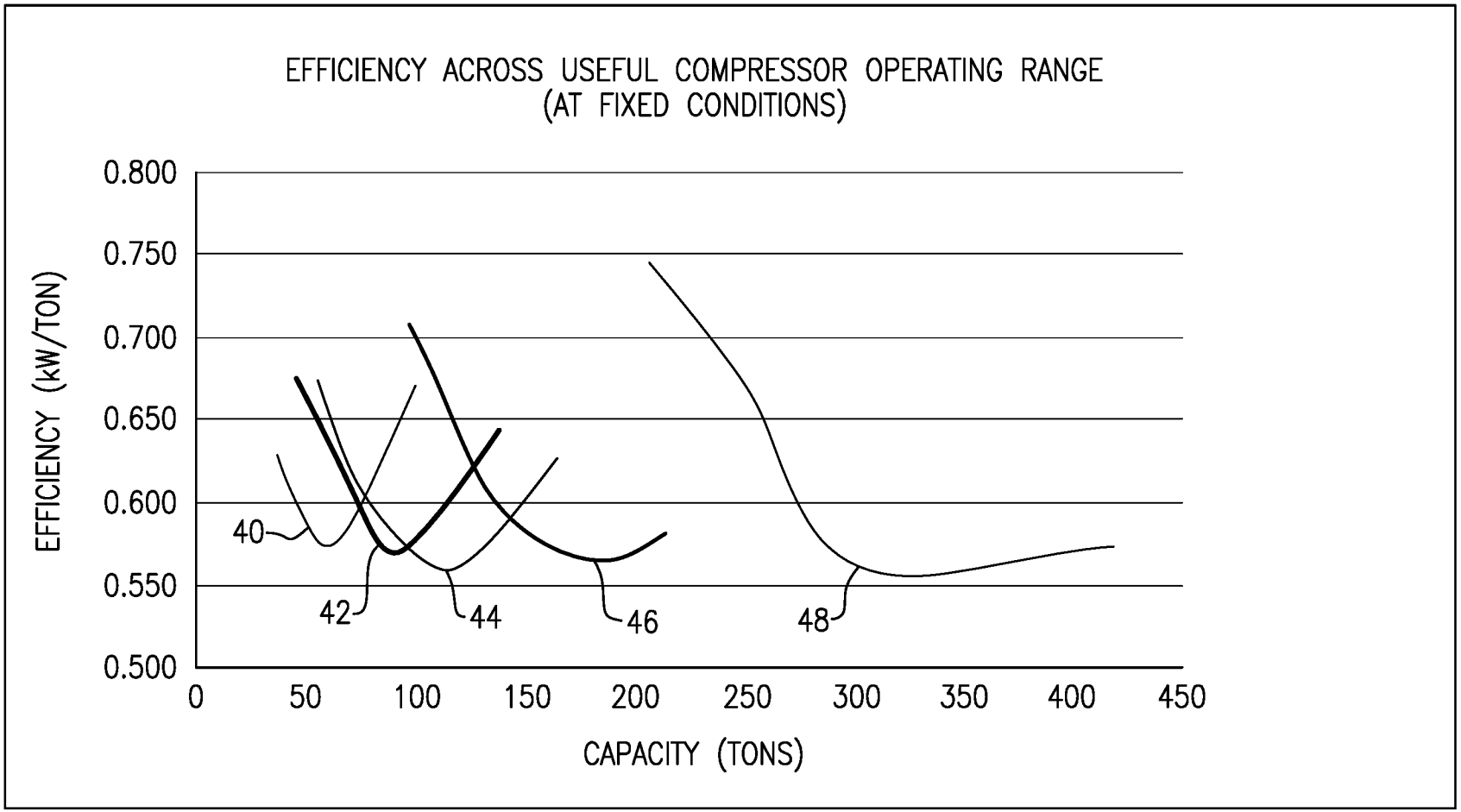
FIG. 3 illustrates exemplary compressor efficiencies for a chiller system.

FIG. 3 illustrates the range of varying efficiency that can be achieved at a given set of conditions for compressors of varying model types. The peak efficiency point is occurring at different locations for each compressor model and the overall compressor operating range is different. In this figure, curve 40 shows efficiency and useful range for a 300 kW compressor, curve 42 shows efficiency and useful range for a 350 kW compressor, curve 44 shows efficiency and useful range for a 400 kW compressor, curve 46 shows efficiency and useful range for a 700 kW compressor, and curve 48 shows efficiency and useful range for a 1200 kW compressor. The mixed model compressor section 14 may include a combination of these compressors, or may include other compressors.

Many known systems use proportional loading. In such systems, multiple compressors of the same size and model are used. When the needs of the system change, the speed of the compressors are changed, but all of the compressors remain operating at the same speed as each other. In systems with different sized compressors, proportional loading means that each compressor would decrease its speed by the same percentage. When a compressor reaches minimum unloading, that compressor will switch off, and the speed of the other compressor(s) will increase to compensate. However, such an arrangement results in the system rarely running at the most efficient operating conditions.

In the present system 10, however, each compressor 30, 32, 34, 36 has its predicted performance embedded. When there is a change in an operating condition, the compressors 30, 32, 34, 36 will adjust to provide the most efficient performance. In some examples, the compressors 30, 32, 34, 36 will unload different amounts. In other examples, one or more compressors 30, 32, 34, 36 will switch off in response to a change in an operating condition.

In some embodiments, each compressor 30, 32, 34, 36 has the predicted performance of all of the other compressors embedded. The plurality of compressors in the system 10 act like a single larger compressor capable of delivering the maximum capacity of the sum of the compressors, and the minimum capacity of the smallest compressor. The compressors 30, 32, 34, 36 respond to system changes independently of each other, and each compressor 30, 32, 34, 36 identifies which compressors should operate and at what speeds to achieve the best overall performance of the system 10.

In some embodiments, two compressors of the same size may operate at different speeds to achieve an efficient performance. For example, one compressor may operate at a demand of 30%, while another compressor of the same size may operate at a demand of 10%. This combination may provide a lower total power than would be achieved if both compressors were operating at 20%. The present system identifies such optimal performance arrangements, regardless of the types of compressors used.

Figure 4:
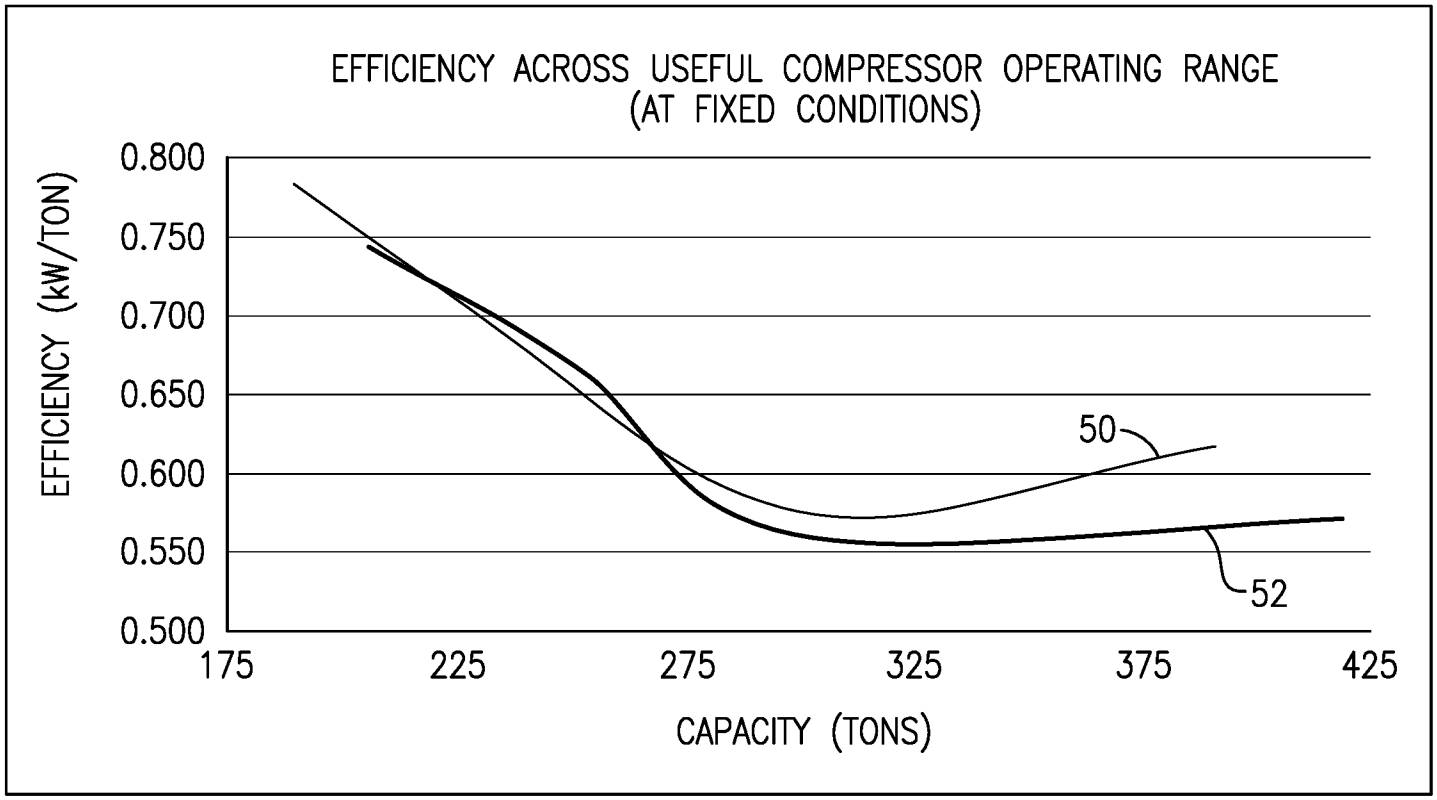
FIG. 4 illustrates exemplary compressor efficiencies for a chiller system.

The controller 38 may also include an economizer switching algorithm. The economizer 21 may be shut off where non-economized performance provides a lower total power. FIG. 4 shows the efficiency across an operating range for a fixed set of conditions comparing the performance with an economizer at curve 50 and without an economizer at curve 52. As the compressor unloads, there is a cross-over where the efficiency is better using non-economized operation. In addition, use of an economizer 21 may limit the minimum allowable capacity that a compressor can provide whereby shutting off the economizer 21 can allow for further capacity reduction. This can also be seen in FIG. 4, where the operating range of the non-economized compressor extends below that of the economized compressor.

The mixed models of compressors and the opportunity for economizer switching allow for better flexibility in the operation of the system 10. Compressors of different sizes allow for a wider operating range and finer control of operating conditions. A mixed model compressor section 14 may provide improvement in the minimum capacity of the chiller system 10. In an embodiment, the different models of compressors are selected to optimize efficiency. A mixed model compressor section 14 may improve both full-load and part-load efficiency of the chiller system 10. In another embodiment, the different models of compressors are selected to optimize overall system cost.

The full-load efficiency of a chiller system 10 having six compressors or fewer may be between about 0.5 and 0.7 kW/Ton for capacities between 0 and 700 tons. When the chiller system 10 is operating above 400 tons, the mixed model chiller yields better full load performance. The part load efficiency of a chiller system 10 having six compressors or fewer may be between about 0.32 and 0.37 kW/Ton for capacities between 0 and 700 tons. When the chiller system 10 is operating above 400 tons, the mixed model chiller yields better full load performance. For chillers operating above 400 tons, the mixed model chiller yields a lower total relative compressor cost.

FIG. 5 shows several different possible compressor arrangements for an example 600 ton water cooled chiller system 10. The mixed model arrangement of the compressor section 14 may be selected for a particular arrangement depending upon whether it is desirable to optimize cost, full load efficiency, or integrated part load value. Where the arrangement is optimized for cost, an example system may include a 1200 kW compressor and a 400 kW compressor. In this example system, the compressor cost is much lower than a fixed model system, while also providing better a full load efficiency and integrated part load value. Where the arrangement is optimized for best integrated part load value, an example system may include a 1200 kW compressor, a 700 kW compressor, and a 300 kW compressor. Where the arrangement is optimized for best full load performance, an example system may include a 1200 kW compressor and a 700 kW compressor. Different combinations of compressors may be useful for optimizing other system parameters, and for different sized systems.

In one example arrangement having two compressors with different cooling capacities, only the low capacity compressor would operate at low capacities, only the high capacity compressor would operate at middle capacities, and both compressors would operate at high capacities. In an example embodiment, for a 600 ton water cooled chiller having a 1200 kW compressor and a 400 kW compressor, only the 400 kW compressor will operate at chiller capacities below 120 tons. When the capacity is between 120 and 360, only the 1200 kW compressor operates, and for capacities more than 360 tons, both compressors will operate. In an example embodiment having a 1200 kW compressor and a 700 kW compressor, only the 700 kW compressor will operate at chiller capacities below 180 tons, only the 1200 kW compressor will operate between 180 and 360 tons, and both compressors will operate for chiller capacities greater than 360 tons. Such loading allows the compressors to operate more efficiently than proportional loading.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A chiller system, comprising:

a compressor section having a first refrigerant compressor having a first nominal cooling capacity and a second refrigerant compressor having a second nominal cooling capacity different from the first nominal cooling capacity, wherein each of the compressors in the compressor section is configured to operate independently of one another;

a controller configured to selectively operate the first and second refrigerant compressors; and wherein the chiller system has a total maximum cooling capacity less than or equal to 700 tons, and a full-load efficiency of the chiller system is between about 0.5 and about 0.7 kW per ton.

2. The chiller system of claim 1, comprising an evaporator upstream of the compressor section and a condenser downstream of the compressor section.

3. The chiller system of claim 2, comprising an economizer configured to deliver fluid from downstream of the condenser to the compressor section.

4. The chiller system of claim 3, wherein the controller is configured to selectively operate the economizer.

5. The chiller system of claim 1, wherein the first and second refrigerant compressors are centrifugal compressors.

6. The chiller system of claim 1, comprising a third refrigerant compressor.

7. The chiller system of claim 6, wherein the third refrigerant compressor has a third nominal cooling capacity that is the same as one of the first nominal cooling capacity and the second nominal cooling capacity.

8. The chiller system of claim 6, wherein the third refrigerant compressor has a third nominal cooling capacity that is different from the first and second nominal cooling capacities.

9. The chiller system of claim 8, wherein the first nominal capacity is 300 kW, the second nominal capacity is 700 kW, and the third nominal capacity is 1200 kW.

10. The chiller system of claim 1, wherein the compressor section has less than or equal to six refrigerant compressors.

11. The chiller system of claim 1, wherein one of the first and second nominal cooling capacities is 700 kW.

12. The chiller system of claim 1, wherein one of the first and second nominal cooling capacities is 300 kW.

13. The chiller system of claim 1, wherein the first nominal capacity is 400 kW and the second nominal capacity is 1200 kW.

14. The chiller system of claim 1, wherein the total maximum cooling capacity is greater than 400 tons.

15. A method of operating a chiller system, comprising:

providing a compressor section having a first refrigerant compressor having a first nominal cooling capacity and a second refrigerant compressor having a second nominal cooling capacity higher than the first nominal cooling capacity, wherein the chiller system has a total maximum cooling capacity less than or equal to 700 tons, and a full-load efficiency of the chiller system is between about 0.5 and about 0.7 kW per ton;

selectively operating the first and second refrigerant compressors with a controller; and selectively operating an economizer with the controller.

16. The method of claim 15, comprising operating the first refrigerant compressor at a different operating load than the second refrigerant compressor while the first and second compressors are both on.

17. The method of claim 15, comprising operating only the first refrigerant compressor when the chiller system is operating at a low capacity.

18. The method of claim 17, comprising operating only the second refrigerant compressor when the chiller system is operating at a medium capacity.

19. The method of claim 18, comprising operating both the first and second refrigerant compressors when the chiller system is operating at a high capacity.

20. The method of claim 19, wherein the low capacity is less than about 120 tons, the medium capacity is between about 120 and about 360 tons, and the high capacity is greater than about 360 tons.

* * * * *